US006513258B1

(12) United States Patent
Casner

(10) Patent No.: US 6,513,258 B1
(45) Date of Patent: Feb. 4, 2003

(54) ADJUSTABLE SCRIBE BLOCK

(76) Inventor: David Patrick Casner, P.O. Box 544, Ahwahnee, CA (US) 93601

( * ) Notice: Subject to any disclaimer, the term of this patent is extended or adjusted under 35 U.S.C. 154(b) by 0 days.

(21) Appl. No.: 09/559,839

(22) Filed: Apr. 26, 2000

Related U.S. Application Data

(63) Continuation-in-part of application No. 08/919,581, filed on Aug. 1, 1997, now abandoned.

(51) Int. Cl.[7] ..... B25H 7/02; G01B 3/30; E04F 21/00; E06B 3/00

(52) U.S. Cl. ..... 33/567.1; 33/194; 33/533; 33/526; 33/613

(58) Field of Search ..... 33/567.1, 194, 33/562, 645, 533, 613, 526, 527

(56) References Cited

U.S. PATENT DOCUMENTS

| | | | | | |
|---|---|---|---|---|---|
| 1,194,749 | A | * | 8/1916 | Kirk | 33/562 |
| 2,144,697 | A | * | 1/1939 | Zangrando | 33/527 |
| 2,607,124 | A | * | 8/1952 | Dery | 33/567.1 |
| 3,626,600 | A | * | 12/1971 | Gaither | 33/613 |
| 4,263,717 | A | * | 4/1981 | Twining | 33/527 |
| 4,381,070 | A | * | 4/1983 | Langbauer | 244/321 |
| 4,882,846 | A | * | 11/1989 | Reed | 33/562 |
| 4,930,221 | A | | 6/1990 | Taylor | 33/811 |
| 5,083,380 | A | * | 1/1992 | Robertson | 33/562 |
| 5,123,172 | A | * | 6/1992 | Thrun | 33/526 |
| 5,325,595 | A | * | 7/1994 | Marlin | 33/526 |
| 5,628,119 | A | * | 5/1997 | Bingham et al. | 33/613 |
| 5,737,844 | A | | 4/1998 | Brumley | 33/194 |
| 6,195,904 | B1 | * | 3/2001 | Greer | 33/527 |

* cited by examiner

*Primary Examiner*—Randy W. Gibson
(74) *Attorney, Agent, or Firm*—Richard A. Ryan

(57) ABSTRACT

A hand-held adjustable scribe block for aiding in the installation of trim around doors and windows includes a first body member and a second body member in a slidable relationship to each other. First body member has a generally planar engagement surface that is in a facing relationship with a generally planar engagement surface on the second body member. First body member includes a longitudinal slot disposed along its longitudinal axis for receiving a pin member to prevent rotation of the first body member relative to the second body member. A locking mechanism, comprising a screw member having an arm member attached thereto, locks the first body member to the second body member to set the longitudinal offset of the two body members. Once set, the user can utilize the scribe block to set the amount of distance the trim is set back from the door jamb or window opening. The first ends of both body members is shaped at a 90 degree angle to facilitate locating the inside corner of the door or window trim.

10 Claims, 2 Drawing Sheets

ADJUSTABLE SCRIBE BLOCK

CROSS-REFERENCE TO RELATED APPLICATIONS.

This application is a continuation-in-part of U.S. patent application Ser. No. 08/919,581 filed on Aug. 1, 1997 abandoned.

BACKGROUND OF THE INVENTION

1. Field of the Invention

The field of the present invention relates generally to the field of scribe blocks used as gauges for the sizing and fitting of trim, such as the wood moldings around windows and doors. More specifically, the present invention relates to such scribe blocks that allow the user to precisely set the inside corner of the trim and the desired amount of trim setback.

2. Background

Most doors and many windows have trim around the outside of the window or the door. Most often, this trim is wood molding that must be placed around the door or window opening by a skilled carpenter. The typical door or window installation requires the wooden molding to be installed around a rectangular or square opening and set back a specified amount of distance from the edge of the door jamb or window opening. This distance is often referred to as the trim setback. Typically the amount of trim setback is very small, usually ranging from one-eighth inch to one-half inch. The skilled carpenter must ensure that the trim setback is evenly spaced all around the door jamb or window opening in order to obtain the usually desired aesthetic arrangement. The same trim setback may be used for all doors or windows in an entire house.

To install the trim, the typical carpenter utilizes tools such as a tape measure or combination square or an "eyeball" approach that is an estimate of the necessary setback. Most known gauges used to set the amount of trim setback are rather large and somewhat unwieldy to use and are not able to accurately set the 90° inside corner around the door or window opening. In addition, many of the prior art trim gauges that are available are manufactured for a certain amount of setback and do not allow the carpenter to adjust the gauge for desired amounts of setback. Those that are adjustable do not allow the user to precisely set and lock in the amount of setback for a desired job (i.e., all the doors in an entire house).

Setting the inside corner of the trim, which is the corner nearest the corners of the door jamb or window opening, is difficult to do with presently available tools and trim methods. None of the known trim gauges allow the user to precisely and concurrently set the 90° inside corner while allowing the user to adjustably set the amount of setback. For instance, U.S. Pat. No. 5,329,703 to Craig, U.S. Pat. No. 1,433,559 to Lowenstein and United Kingdom Patent No. 595,190 to Kullager-Fabriken disclose various gage blocks that could be used to set the amount of set back, but do not allow the user to precisely set the inside corner, particularly concurrent with setting the amount of setback. Although the above-described patents, as well as other related patents, describe trim gauges, none of the related art devices describe, singularly or in combination, a trim gauge or scribe block that concurrently allows the user to precisely set the inside corner of the trim and the amount of trim setback in a small, easy to use device. Consequently, a need exists for an adjustable scribe block that is easy to use and allows the user to concurrently set the inside corner of the trim and the trim setback distance.

SUMMARY OF THE INVENTION

The adjustable scribe block of the present invention provides the benefits and solves the problems identified above. That is to say, the present invention provides a scribe block that can be adjustably set for the desired amount of trim setback and which allows the user to concurrently set the inside corner of the trim. The present invention is a small, hand-held device that is easy to use to quickly set the inside corner of the trim and the amount of trim setback.

The scribe block of the present invention has a first body member and a second body member, each having opposing first and second ends and generally planar engagement surfaces that are in facing relationship to each other. The engagement surfaces must allow the first body member to slide relative to the second body member. The longitudinal axis of the first and second body members are parallel to each other and, in the preferred embodiment, a slot is disposed through the first body member along its longitudinal axis. The first ends of both body members are shaped to a 90° angle for fixing the inside corner of the desired trim. A locking mechanism fixes the longitudinal offset of the first body member relative to the second body member. The longitudinal offset is set to the amount of trim setback desired for a particular door or window trim. In the preferred embodiment, a pin member is disposed in the slot to prevent rotation of the body members relative to each other. In an alternative embodiment, the first body member can be slidably disposed in a cut out section of the second body member to prevent rotation of the two body members relative to each other.

In the preferred embodiment, the locking mechanism comprises a screw member that is disposed in the slot in the first body member to be threadably received in a threaded opening in the second body member. To facilitate locking the two body members together, one end of the screw member can have a locking arm so the user can twist the screw into place. A nut or head on the locking arm can be configured to abut against the first body member upon tightening of the locking mechanism.

The adjustable scribe block of the present invention can be made out of metal, plastic, wood or other materials into a small, hand-held gauge for precisely setting the amount the trim is set back from the door jamb or window opening. To allow the user to accurately set the amount of trim setback, the scribe block of the present invention should include markings on either or both body members that indicate the amount of longitudinal offset between the body members so that the user can set the trim setback distance.

Accordingly, the primary objective of the present invention is to provide an adjustable scribe block that allows a user to precisely set the trim setback distance and the inside corner of the trim for placing molding or other trim around doors and windows.

It is also an important objective of the present invention to provide a hand-held, easy to use adjustable scribe block that locates the inside corner for door or window trim and which can be set to precise trim setback amounts.

It is also an important objective of the present invention to provide an adjustable scribe block that has two body members which slidably abut each other, a mechanism for preventing rotation of the body members relative to each other and a locking mechanism for selectively locking the body members together at the desired amount of trim setback distance.

The above and other objectives of the present invention will be explained in greater detail by reference to the attached figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
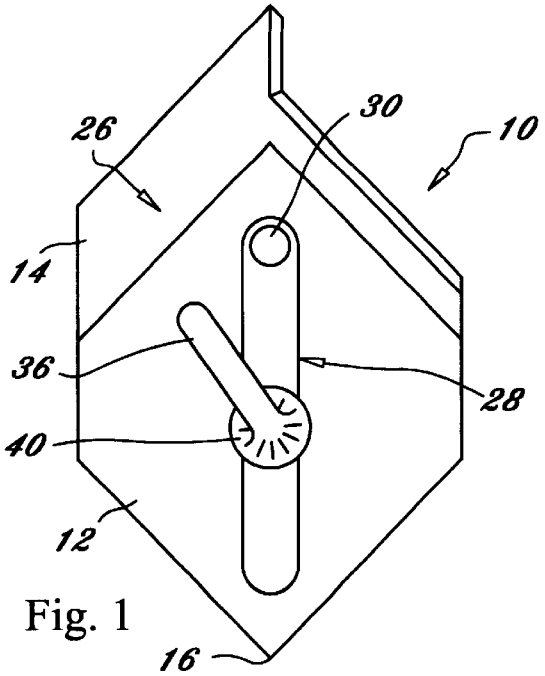
FIG. 1 is a top view of the adjustable scribe block of the present invention.
Figure 3:
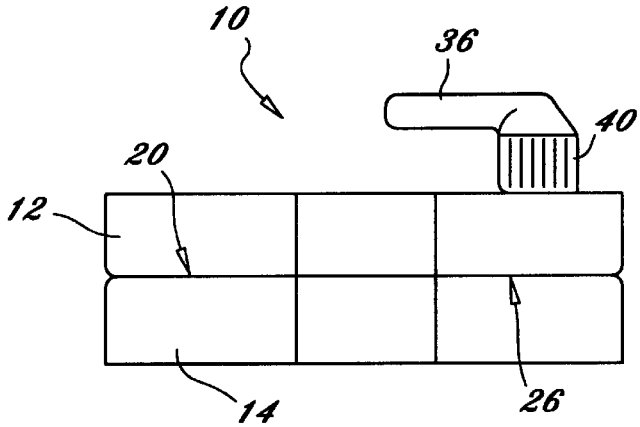
FIG. 3 is a side view of the present.
Figure 2:
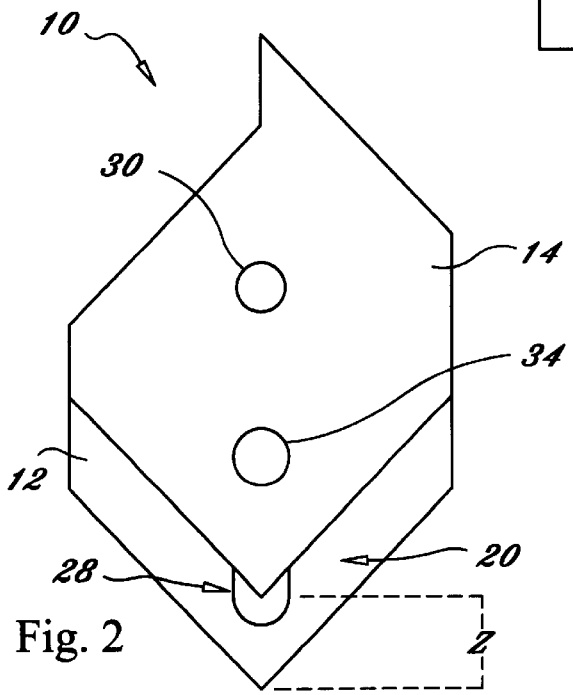
FIG. 2 is a bottom view of the present invention.

With reference to the figures where like elements have been given like numerical designations to facilitate the reader's understanding of the present invention, and particularly with reference to the embodiment of the present invention illustrated in FIGS. 1 through 6, the preferred embodiment of the present invention is set forth below. The adjustable scribe block, designated generally as 10, is designed and configured to facilitate setting the inside corner and setback distance for trim around doors and windows. As shown in FIGS. 1, 2 and 3, scribe block 10 comprises a first body member 12 and a second body member 14 that slidably abut each other. First 12 and second 14 body members can be made out of metal, plastic, wood or other materials. The preferred material is a light weight metal such as aluminum or stainless steel that is generally resistant to corrosion, wear and damage from normal use. The size of completed scribe block 10 should be such that it is easy to use with one hand and small enough to be carried in a pocket or tool belt.

First body member 12 has opposing first end 16 and second end 18 and first engagement surface 20 disposed between its two ends 16 and 18. First end 16 is configured to be shaped in a 90° angle. First body member 12 has a longitudinal axis X, as best shown on FIG. 4. In the preferred embodiment, first 16 and second 18 ends are along longitudinal axis X. Second body member 14 has opposing first end 22 and second end 24 and second engagement surface 26 disposed between its two ends 22 and 24. First end 22 is configured to be shaped in a 90 degree angle. Second body member 14 has a longitudinal axis Y, as best shown on FIG. 5. In the preferred embodiment, first 22 and second 24 ends are along longitudinal axis Y. First 20 and second 26 engagement surfaces are in facing relationship with each other and, therefore, should be generally planar so that the two body members 12 and 14 can slide relative to each other. As the two body members 12 and 14 slide relative each other a longitudinal offset Z is formed, as shown in FIG. 2. The longitudinal offset Z is adjusted to be equal to the amount of trim setback desired for the molding or other type of trim that goes around a door or window. First body member 12 or second body member 14 can have marks thereon (not shown) that correspond to various measurements so the use of scribe blocks 10 can precisely set the longitudinal offset Z to the desired trim setback distance.

Figure 4:
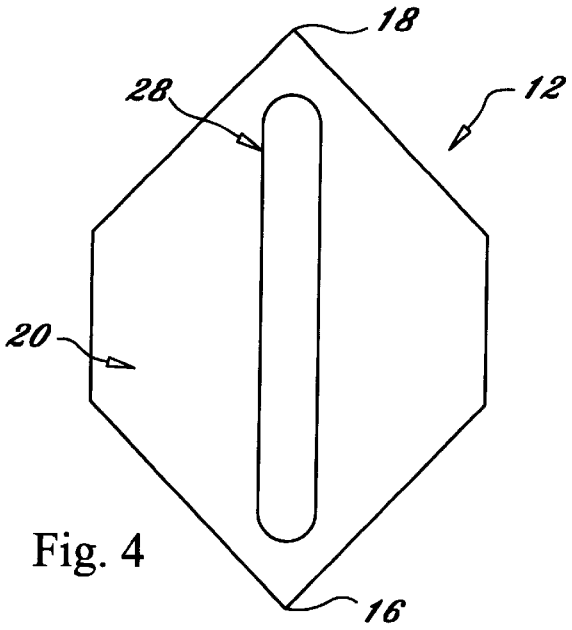
FIG. 4 is a bottom view of the first block member of the present invention showing the first engagement surface.
Figure 5:
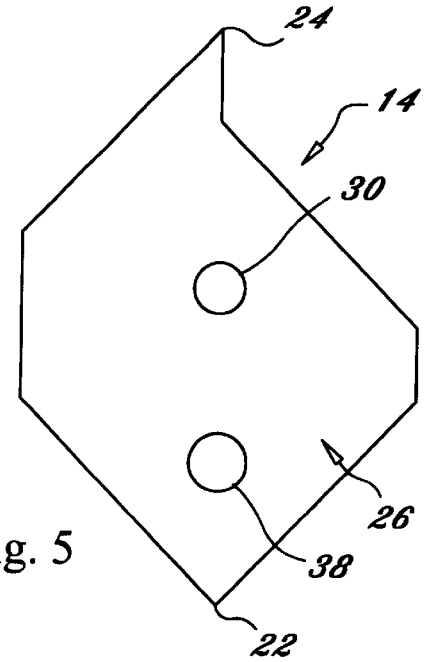
FIG. 5 is a top view of the second block member of the present invention showing the second engagement surface.
Figure 6:
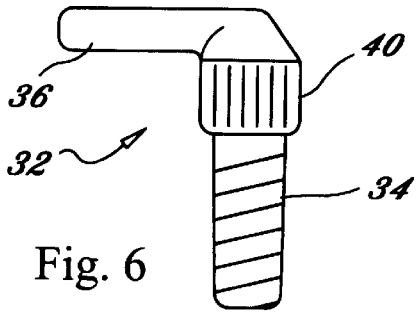
FIG. 6 is a side view of the preferred locking mechanism for the present invention.

To facilitate use of scribe block 10, first body member 12 and second body member 14 should comprise a mechanism for preventing rotation of body member 12 relative to body member 14 to prevent inaccurate and changing setback distances. In the preferred embodiment, first body member 12 has longitudinal slot 28 through body member 12. Also in the preferred embodiment, longitudinal slot 28 extends substantially from first end 16 to second end 18 of first body member 12, as best shown in FIGS. 1 and 4. Pin 30, shown best in FIGS. 1 and 5, mounted on or attached to second body member 14 protrudes from second engagement surface 26 to be slidably disposed inside slot 28 to prevent rotation of first body member 12 relative to second body member 14 when used in conjunction with the locking mechanism 32 described below.

Once the desired longitudinal offset Z is obtained, it is necessary to lock the position of the first body member 12 relative to the second body member 14 to keep the desired trim setback distance consistent while setting the trim around the subject door or window and from one door or window to another, as may be desired. In the preferred embodiment, locking mechanism 32 (shown in FIG. 6) comprises a screw member 34 affixed to a locking arm member 36. Screw member 34 is disposed in slot 28 such that arm member 36 protrudes above first body member 12, as shown in FIGS. 1 and 3. Screw member 34 is threadably received in threaded opening 38 in second body member 14 (shown in FIG. 5). Arm 36 facilitates rotation of screw member 34 into threaded opening 38. To lock first body member 12 to second body member 14, a nut or other protrusion 40 compresses against first body member 12 to hold it in place against second body member 14.

In use, the user first loosens the locking mechanism 32 by rotating arm 36 so that first body member 12 can slide relative to second body member 14. First body member 12 is slid a sufficient amount to obtain the desired trim setback distance as indicated by the longitudinal offset Z between body members 12 and 14. Once the desired distance is set, arm 36 is rotated to cause screw 34 to threadably engage in threaded opening 38 and cause protrusion 40 to compress against first body member 12 and hold first body member 12 against second body member 14 and lock the longitudinal offset Z in place. The 90° angle of first ends 16 and 22 of first body member 12 and second body member 14, respectively, is placed in the corner of the door jamb or window opening to set the inside corner of the trim around the door or window. The trim is then set in place utilizing the longitudinal offset Z between the first 12 and second 14 body members.

Figure 7:
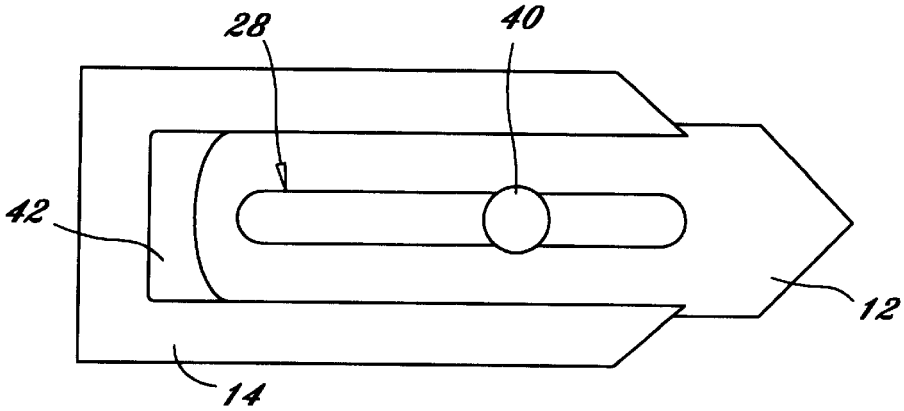
FIG. 7 is a top perspective view of an alternative embodiment of the present invention showing the use of a first body member slidably engaged in the second body member.

In an alternative embodiment, shown in FIG. 7, pin 30 is replaced by a mechanism whereby first body member 12 is slidably disposed in a cut out section 42 of second body member 14. The longitudinal sides 44 of cut out section 42 prevent rotation of first body member 12 relative to second body member 14. Longitudinal sides 44 can have a lip portion (not shown) that extends over first body member 12 to keep it in cut out section 42.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. An adjustable scribe block for positioning a setback distance and a corner location for a section of trim around an opening for a window or door, said adjustable scribe block comprising:

a first body member having a first end and an opposing second end, a generally planar first engagement surface disposed between said first and second ends and a slot disposed in said first body member substantially along a longitudinal axis interconnecting said first end and said second end, said first end of said first body member shaped to a 90 degree angle to set the corner location of the trim;

a second body member having a first end and an opposing second end and a generally planar second engagement surface disposed therebetween, said second body member having a longitudinal axis, said first engagement surface and said second engagement surface disposed in facing relationship and configured to allow said first body member to slidably move relative to said second body member along said longitudinal axis of said first body member, said first end of said second body member configured for placement in the opening of the window or door, said first end of said first body member configured to move relative to said first end of said second body member along said longitudinal axis of said first body member a desired longitudinal offset amount so as to establish the setback distance when said first end of said second body member is placed in the opening of the window or door;

rotation prevention means for preventing rotation of said first body member relative to said second body member; and locking means disposed in said slot for locking said first body member to said second body member to selectively fix said longitudinal offset of said first body member relative to said second body member.

2. The adjustable scribe block according to claim 1, wherein said first end of said second body member is shaped to a 90 degree angle.

3. The adjustable scribe block according to claim 1, wherein said rotation prevention means comprises a pin member protruding from said second engagement surface, said pin member slidably disposed in said slot in said first body member.

4. The adjustable scribe block according to claim 1, wherein said rotation prevention means comprises a cut out section in said second body member and said first body member slidably disposed in said cut out section.

5. The adjustable scribe block according to claim 1, wherein said locking means comprises a screw member disposed in said slot and threadably received in a threaded opening in said second body member.

6. The adjustable scribe block according to claim 5, wherein said screw member comprises an arm member for rotating said screw member and actuating said locking means.

7. The adjustable scribe block according to claim 6, wherein said screw member further comprises a protrusion to compress against said first body member and lock said first body member to said second body member.

8. The adjustable scribe block according to claim 5, wherein said screw member comprises a protrusion to compress against said first body member and lock said first body member to said second body member.

9. An adjustable scribe block for positioning a setback distance and a corner location for a section of trim around an opening for a window or door, said adjustable scribe block comprising:

a first body member having a first end and an opposing second end, a generally planar first engagement surface disposed between said first and second ends and a slot disposed in said first body member substantially along a longitudinal axis interconnecting said first end and said second end, said first end of said first body member shaped to a 90 degree angle to set the corner location of the trim;

a second body member having a first end and an opposing second end and a generally planar second engagement surface disposed therebetween and a pin member protruding from said second engagement surface, said second body member having a longitudinal axis, said first engagement surface and said second engagement surface disposed in facing relationship and configured to allow said first body member to slidably move relative to said second body member along said longitudinal axis of said first body member, said pin member slidably disposed in said slot for preventing rotation of said first body member relative to said second body member, said first end of said second body member shaped to a 90 degree angle for placement in the opening of the window or door, said first end of said first body member configured to move relative to said first end of said second body member along said longitudinal axis of said first body member a desired longitudinal offset amount so as to establish the setback distance when said first end of said second body member is placed in the opening of the window or door; and locking means disposed in said slot for locking said first body member to said second body member to selectively fix said longitudinal offset of said first body member relative to said second body member, said locking means comprising a screw member disposed in said slot and threadably received in a threaded opening in said second body member.

10. The adjustable scribe block according to claim 9, wherein said screw member comprises an arm member for rotating said screw member and actuating said locking means and a protrusion to compress against said first body member and lock said first body member to said second body member.

* * * * *